United States Patent [19]

Gleyze

[11] 3,938,749

[45] Feb. 17, 1976

[54] DEVICE FOR DOFFING A FULL BOBBIN ON A TEXTILE MACHINE

[75] Inventor: Jean Gleyze, St. Pierre de Colombier, France

[73] Assignee: Societe Civile Textile dite Societex, Lyon, France

[22] Filed: May 20, 1974

[21] Appl. No.: 471,974

[30] Foreign Application Priority Data

May 21, 1973 France ..... 73.18446

[52] U.S. Cl. ..... 242/18 PW; 242/18 A; 242/19

[51] Int. Cl.[2] ..... B65H 67/04

[58] Field of Search ..... 242/18 PW, 18 DD, 18 R, 242/18 A, 19, 35.5 R, 35.5 A

[56] References Cited

UNITED STATES PATENTS

| | | | |
|---|---|---|---|
| 2,791,384 | 5/1957 | Furst | 242/19 X |
| 3,507,453 | 4/1970 | Scragg et al. | 242/18 A |
| 3,682,403 | 8/1972 | Willis | 242/18 A |
| 3,791,126 | 2/1974 | Kose et al. | 242/18 R X |
| 3,801,030 | 4/1974 | Kobatake et al. | 242/18 PW X |

*Primary Examiner*—Stanley N. Gilreath
*Attorney, Agent, or Firm*—Michael J. Striker

[57] ABSTRACT

A device for a textile machine for doffing full bobbins, loading empty bobbin tubes, and forming an attachment tail on the bobbin tube. The device includes a pair of arms supporting a bobbin tube at opposite ends and being pivotable between a winding position in which a yarn is wound on the tube and a releasing position in which a full bobbin can be removed by moving one of the arms away from the other. The device includes also a reserve lever for forming an attachment tail on a new bobbin tube when the latter is in the driving position. The reserve lever is operated during movement of the arms between the positions thereof by transmission means between the pivot shaft of the arms and the lever. in the driving position. The reserve lever is operated during

10 Claims, 7 Drawing Figures

DEVICE FOR DOFFING A FULL BOBBIN ON A TEXTILE MACHINE

BACKGROUND OF THE INVENTION

The present invention relates to a device for changing full bobbins on textile machines and for loading empty bobbin tubes thereon. This operation is usually described as "change-over" operation.

The invention is particularly suitable for, but not limited to, false twist texturizing machines.

On such machines, as on a large number of other textile machines (twisters and the like), the receiving bobbins are lined up from position to position on several levels in the lengthwise direction of the machine. This arrangement makes it possible to produce full bobbins of suitable dimensions despite the small distance between the positions, and this considerably reduces the floor space occupied by such machines.

When a bobbin is full, or when the yarn is broken, it is necessary to remove the bobbin from the machine and then to position an empty bobbin tube in order to wind the yarn thereon to thus produce a yarn package on the tube.

Usually, the so-called "doffing" operations are carried out manually, position by position, but this procedure is not only time consuming, but also involves substantial loss of yarn because during this change-over operation, the treatment machine continues to produce yarn. This loss of yarn is the greater, the higher is the speed of the machine.

Entirely automatic doffing systems have already been made, that is, systems which carry out all of these operations without manual intervention. However, these systems, which give excellent results, have the disadvantage of being extremely expensive to manufacture so that they have not been commercially successful hitherto.

SUMMARY OF THE INVENTION

It is an object of the present invention to provide in a textile machine a device for changing bobbins and loading empty bobbin tubes for winding yarns thereon in which this doffing operation can be carried in very efficient manner while the device for carrying out this operation is simple in construction so that it can be manufactured at reasonable cost.

It is a further object of the present invention to provide a device of the aforementioned kind in which also after placing of a new bobbin tube in the device a reserve or attachment tail of yarn is formed on the bobbin tube in an automatic manner.

With these and other objects in view, which will become apparent as the description proceeds, the device of the present invention for changing bobbins and loading empty bobbin tubes on a textile machine mainly comprises means for releasably supporting an empty bobbin tube at opposite ends and including a pair of spaced substantially parallel arms having each at one end, tube engaging means adapted to engage a tube at opposite ends and being in the region of the other ends thereof connected to each other for simultaneous pivotal movement about a first pivot axis, substantially parallel to the axis of a tube so mounted, between a first position in which the tube is in a yarn winding position and a second position in which the tube is in a releasing position, means connected to the bobbin tube supporting means for pivoting the same between the positions thereof, and means for moving at least one of the arms away from the other as the bobbin tube supporting means approaches the second position to release a bobbin tube from the engaging means.

The device includes preferably further a cradle pivotable about the aforementioned first pivot axis, means on the arms engaging the cradle during pivoting of the bobbin tube supporting means from the first to the second position for moving the cradle to a corresponding position to receive a full bobbin upon release of the bobbin tube from the bobbin tube supporting means, wherein the engaging means on the arms are arranged in such a manner that the cradle may stay in the second position upon return of the bobbin tube supporting means to the first position.

The device includes further yarn supply means, cutting means for cutting yarn between the yarn supply means and the bobbin, when the latter is received by the cradle, and temporary yarn recovery means cooperating with the end of the yarn emanating from the supply means. These temporary yarn recovery means preferably comprise a receptacle connected to a source of vacuum and a suction tube communicating with the receptacle and having an open end adjacent the yarn extending from the yarn supply means to the bobbin received in the cradle so as to suck the cut end of the yarn into the receptacle.

Furthermore, the device preferably includes means for forming an attachment tail on an empty bobbin tube supported by the supporting means in the first position of the latter. These means for forming an attachment tail comprise a reserve arm having a hook end and being pivotable about a second pivot axis in a plane intersecting the yarn extending from the yarn supply means to the open end of the suction tube, between a rest position disengaged from the yarn to an engaging position displacing the yarn. A transmission is provided between the bobbin tube supporting means and the reserve arm for moving the latter between the rest and the engaging position during movement of the bobbin tube supporting means between the positions thereof. Each of the arms of the bobbin supporting means carries at the one end thereof circular side plates and one of which is provided with a toothed periphery cooperating with the reserve arm in forming the attachment tail.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS:

As already stated, the device according to the invention is particularly suitable for, but not limited to, false twisting texturizing machines, and this constitutes the example illustrated. Such machines consist of various units lined up horizontally and superposed on several levels, it being understood that, for the convenience of the description, only one of these units has been represented.

Figure 1:
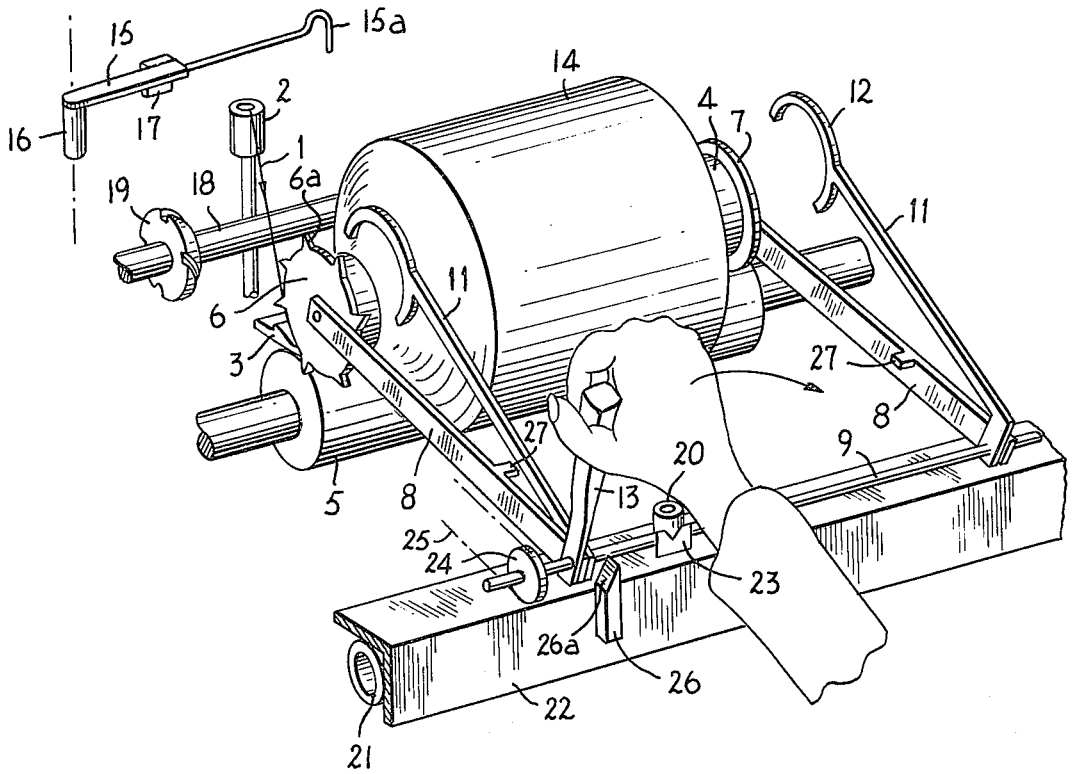
FIG. 1 is a schematic perspective view of the device for changing bobbins and loading empty bobbin tubes on textile machine and for forming a reserve tail on a new empty bobbin tube placed on the device.

FIG. 1 shows the device in a winding-up position in which a yarn 1 continuously supplied from a yarn supply means or supply duct 2, for example the outlet of an oven for the heat treatment in a texturizing operation, passes through a reciprocating yarn guide 3 to be wound up on a bobbin tube 4 which is rotated by frictionally engaging a drive cylinder 5. The yarn guide 3 is reciprocated in the direction of the axis of the tube 4 in known manner by means well known in the art and not shown in the drawing and the drive cylinder 5 is continuously rotated about its axis by drive means, likewise not shown.

Both ends of the tube are gripped between side plates 6 and 7 of bobbin tube supporting means comprising a pair of spaced substantially parallel arms 8 carrying at the free ends thereof the aforementioned side plates or tube engaging means 6 and 7 for rotation about the axis thereof, and the arms 8 are connected at the other ends thereof to a shaft 9 extending substantially parallel to the axis of the tube 4 mounted between the side plates, for simultaneously pivoting movement about the axis of the shaft 9 during turning of the latter.

The device inludes further a cradle having two arms 11, each carrying at the free end thereof an end portion 12 of substantially semi-circular configuration having a radius slightly larger than the radius of the tube 4 and the opposite ends of the cradle arms 11 being freely turnably mounted on the shaft 9.

Figure 3:
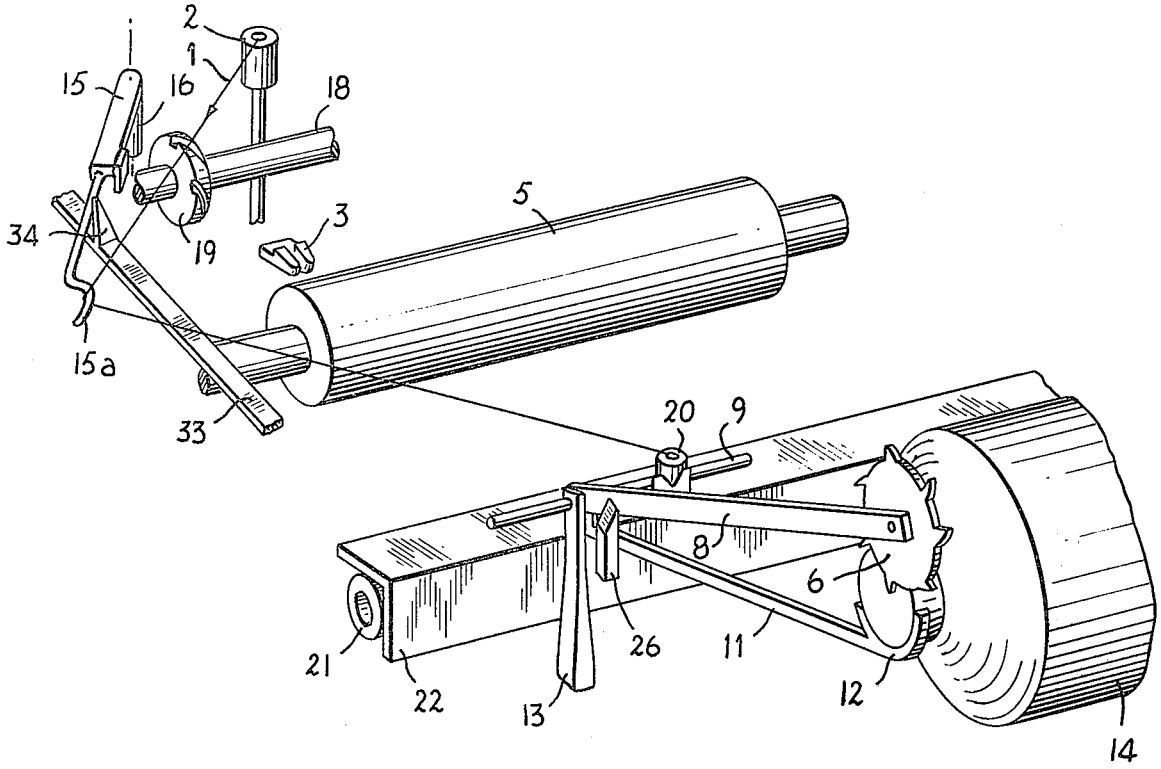
FIG. 3 is a partial perspective view similar to FIG. 1 showing the bobbin tube supporting means moved to the releasing position and a full bobbin received in the cradle.

A lever 13 is fixed at one end thereof to the shaft 9 so that upon manually operating the lever 13 in the manner indicated in FIG. 1, the arms 8 of the bobbin tube supporting means may be moved from the yarn winding position as shown in FIG. 1 to the release position as shown in FIG. 3. During such movement of the arms 8, inwardly extending projections 27 on the arms will engage the cradle arms 11 to move the latter to the position as shown in FIG. 3 in which the cradle arms 11 are prevented from turning further by stops, not shown in the drawing.

As the arms 8 approach, during their pivoting about the axis of the shaft 9, the position as shown in FIG. 3, at least one of the arms, for instance the left arm as shown in FIG. 1, is engaged by the inclined face 26*a* of a stationary cam 26 so that the upper end of the arm 8 carrying the side plate 6 is flexed in outward direction, whereby the bobbin tube 4 clamped between the side plate 6 and 7 is released, and the opposite ends of the tube 4 are received in the semi-circular end portions 12 of the cradle arms as shown in FIG. 3. The cradle arms 11 will remain in the position as shown in FIG. 3 upon returning of the arms 8 by means of the lever 13 to the position as shown in FIG. 1, and the cradle arms 11 may subsequently be manually returned to the position shown in FIG. 1, or torsion springs, not shown in the drawing, wound about the shaft 9 and engaging the cradle arms may be used to return the cradle arms to the position as shown in FIG. 1, after removing of a full bobbin 14 from the semi-circular end portions 12 of the cradle arms. Such torsion springs have to be constructed in such a manner that the cradle arms will remain in the position as shown in FIG. 3, as long as a full bobbin is supported thereon, but to return the cradle arms to the position as shown in FIG. 1 when the full bobbin is removed from the semi-circular end portions 12 of the cradle arms.

The device inludes further temporary yarn recovering means comprising a receptacle 21 mounted on a support 22 and connected to a source of vacuum, not shown in the drawing, and a suction tube communicating with the receptacle and having an open end 20 adjacent the shaft 9; and cutting means 23 stationarily mounted on the support 22 adajcent the opening 20 of the suction tube.

Figure 2:
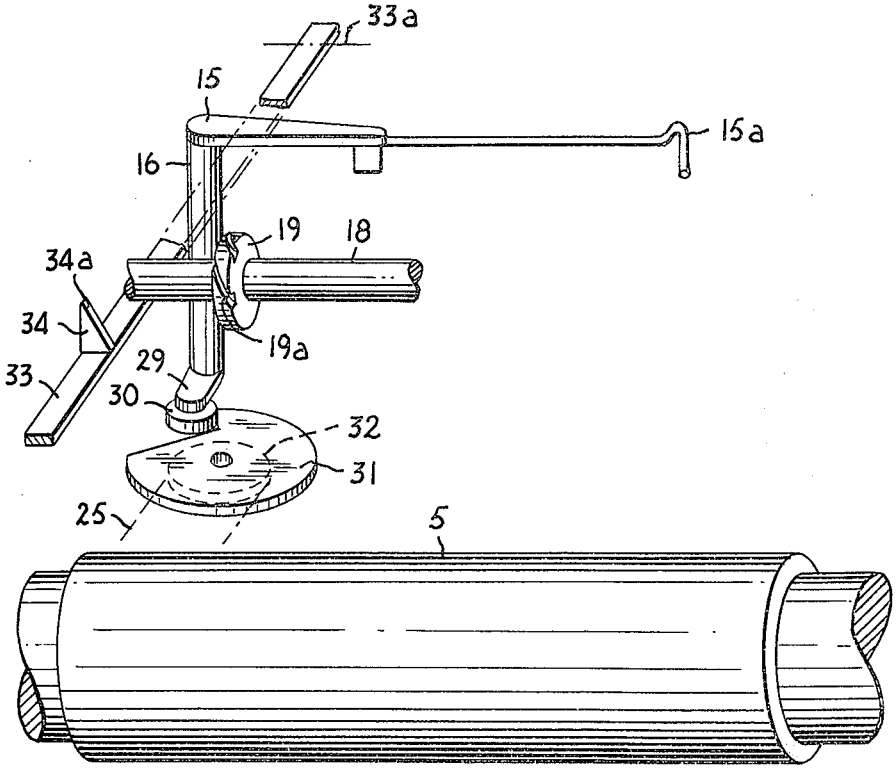
FIG. 2 is a schematic prespective view illustrating certain elements of the device for moving the reserve arm between the positions thereof, which elements have been omitted, for clarities' sake, from FIG. 1.

The device also includes a reserve arm 15 fixedly connected at one end to a shaft 16 for rotation therewith and being provided at the opposite free end with a hook portion 15*a* adapted to engage a yarn 1 extending from the yarn supply tube to the suction opening 20, in the manner as will be described later on, during turning of the reserve arm 15 with the shaft 16 about the axis of the latter. An arm 29, fixed to shaft 16, projects transverse to the axis of the shaft 16 from the lower end thereof and this arm carries at the free end thereof a roller follower 30 engaging a cam 31 as shown in FIG. 2. A spring, not shown in the drawing, biases the arm 29 and the roller follower 30 carried thereby in continuous engagement with the peripheral surface of the cam 31. The cam 31 is connected by transmission means to the shaft 9 so that the cam is turned during turning of the shaft 9 by the lever 13 as the arms 8 of the bobbin tube supporting means are moved between the aforementioned positions thereof. Such transmission means may include a pulley 32 coaxially fixed to the cam 31, a pulley 24 (FIG. 1) fixed to the shaft 9 for turning therewith, and an endless belt 25 extending over the pulleys 24 and 32 and being guided between the pulleys over guide rolls not shown in the drawing. The belt 25 is preferably a toothed belt and the pulleys 24 and 32 are provided with corresponding teeth to prevent slippage of the belt with respect to the pulleys. The reserve arm 15 includes between the opposite ends thereof a catch 17 connected to the reserve arm for instance by a spring, now shown in the drawing, to be slightly yieldable with respect thereto and to be normally held in the position as shown in FIG. 2. This catch is adapted to cooperate, in the manner as will be described later on in detail, with slanted grooves 19*a* provided on the peripheral surface of a wheel 19 fixed to a shaft 18 extending substantially normal to the shaft 16 and being driven by means, not shown in the drawing, in a fixed relationship to the rotation of the drive cylinder 5, for instance by a reduction gearing between the driven cylinder 5 and the shaft 18 so that the latter will be rotated at a considerably slower rotational speed than the cylinder 5.

The device includes further locking means for temporarily locking the reserve arm 15 in a turned position to which the reserve arm is moved by the aforementioned transmission means. These locking means include an arm 33 pivotable about an axis 33*a* (FIG. 2) and carrying spaced from the axis 33*a* an upwardly extending projection 34 of substantially triangular configuration located in the path of the reserve arm 15 as the latter is moved from the position shown in FIG. 2 to the position shown in FIG. 3.

The above-described apparatus will operate as follows:

In FIG. 1 the device is shown in the winding position in which the yarn 1 continuously supplied from the supply tube 2 passes over the reciprocating yarn guide 3 and is wound up on the bobbin tube 4, which is made of cardboard or the like, and which is rotated by the drive cylinder 5. When the bobbin is full, the operator (whose hand is shown in FIG. 1) pivots the lever 13 towards the front.

This movement turns shaft 9 in clockwise direction and correspondingly moves the arms 8 of the bobbin tube supporting means from the position as shown in FIG. 1 to the position as shown in FIG. 3. During this turning of the arm, the projections 27 thereon will engage the arms 11 of the cradle to turn the same likewise to the position as shown in FIG. 3. As the arms 8 of the bobbin tube supporting means approach the position as shown in FIG. 3, the slanted face 26*a* of the stationary cam 26 will engage the left arm, as viewed in FIG. 1, to move the upper end thereof carrying the side plate 6 in outward direction so that the full bobbin 14 will be released from the bobbin tube supporting means and be received in the semi-circular end portions 12 on the free ends of the cradle arms 11 as shown in FIG. 3. During such movement of the bobbin tube supporting means and the cradle, the yarn 1 will become disengaged from the yarn guide 3 and a portion of the yarn will be located on the suction opening 20 of the temporary yarn recovering means. The operator then cuts the yarn, for example by means of the cutting means or knife 23 positioned downstream of the orifice 20 by pressing a portion of the yarn downstream of the orifice against the cutting edge of the knife 23. The cut end of the yarn coming from the yarn supply tube 2 is then sucked through the suction orifice 20 into the waste receptacle 21.

As described above, transmission means are provided between the shaft 9 and the reserve lever 15 so that as the arms 8 of the bobbin tube supporting means are turned by means of the handle 13 from the position shown in FIG. 1 to the position shown in FIG. 3, the cam 31 connected by the described transmission means to the shaft 9 will be turned correspondingly so that the reserve arm 15 will be turned from the position shown in FIGS. 1 and 2 to the position as shown in FIG. 3. The shaft 16 and the reserve arm 15 connected thereto are arranged in such a manner that during turning of the reserve arm between the aforementioned two positions the hook end 15*a* of the reserve arm will engage the yarn 1 extending between the supply tube 2 and the suction orfice 20 so as to deflect the yarn as shown in FIG. 3. During such movement of the reserve arm 15 from the rest position as shown in FIG. 1 to the engaging position as shown in FIG. 3, the arm 15 will engage the inclined face 34*a* of the projection 34 on the arm 33 to thereby pivot the arm 33 about the pivot axis 33*a* so that the reserve arm 15 may pass the aforementioned projection, whereafter the arm 33 biased by gravity or by a spring, not shown, to the position shown in FIG. 2, will return into this position so that the reserve arm 15 will be held in the position as shown in FIG. 3.

The catch 17 is a plate articulated on a spring, not shown, on the arm 15. When the catch 17 passes over the wheel 19 during turning of the lever from rest position shown in FIG. 1 to turned position shown in FIG. 3, the said catch 17 may tilt to pass over the wheel 19.

Figure 4:
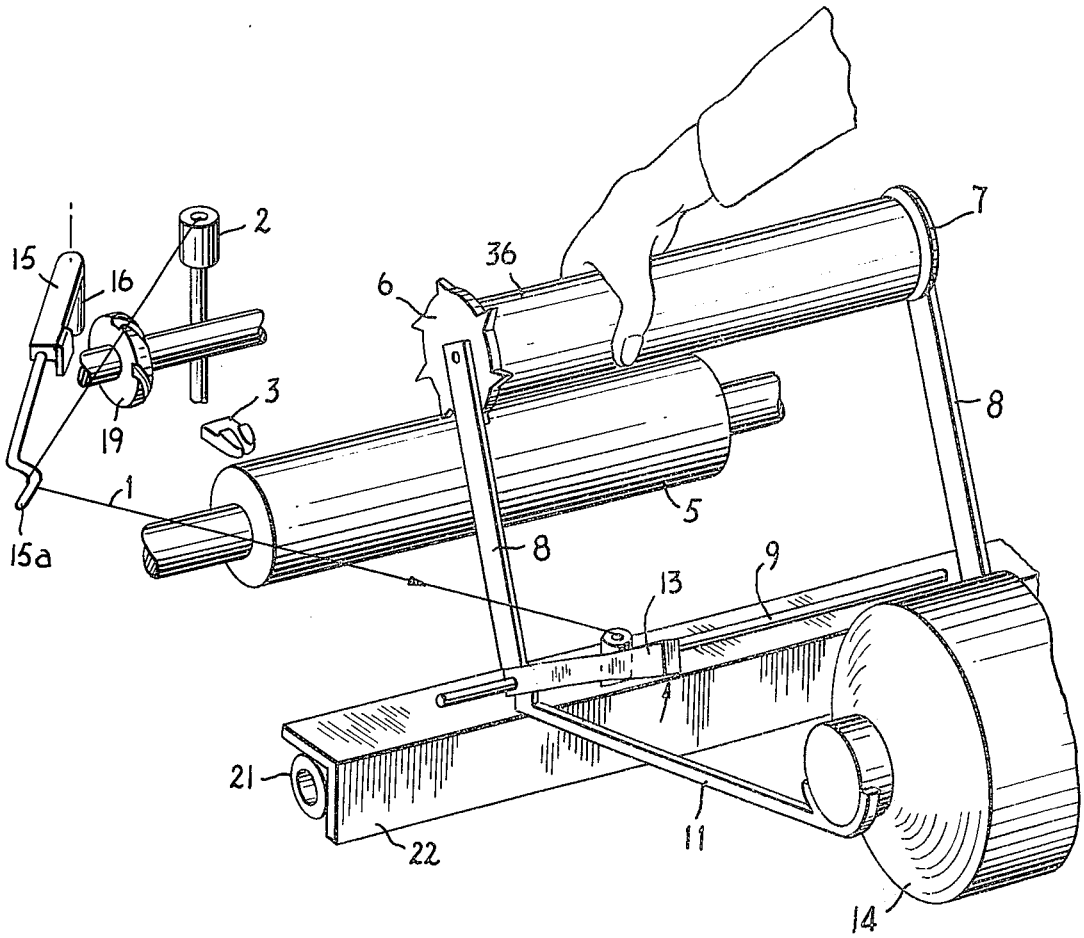
FIG. 4 is a partial perspective view similar to FIG. 1 and showing a new empty bobbin tube placed in the bobbin tube supporting means while the latter are being moved back to the position as shown in FIG. 1.
Figure 5:
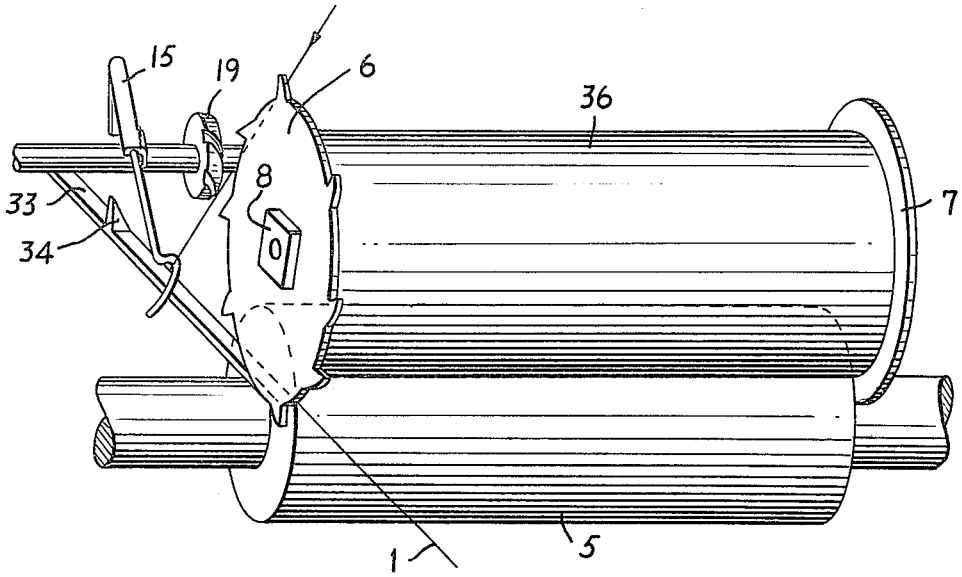
FIGS. 5 and 6 are partial perspective views illustrating the empty bobbin tube in the position as shown in FIG. 1 and illustrating further the cooperation of the reserve arm with the toothed periphery of one of the side plates for forming a reserve tail.
Figure 6:
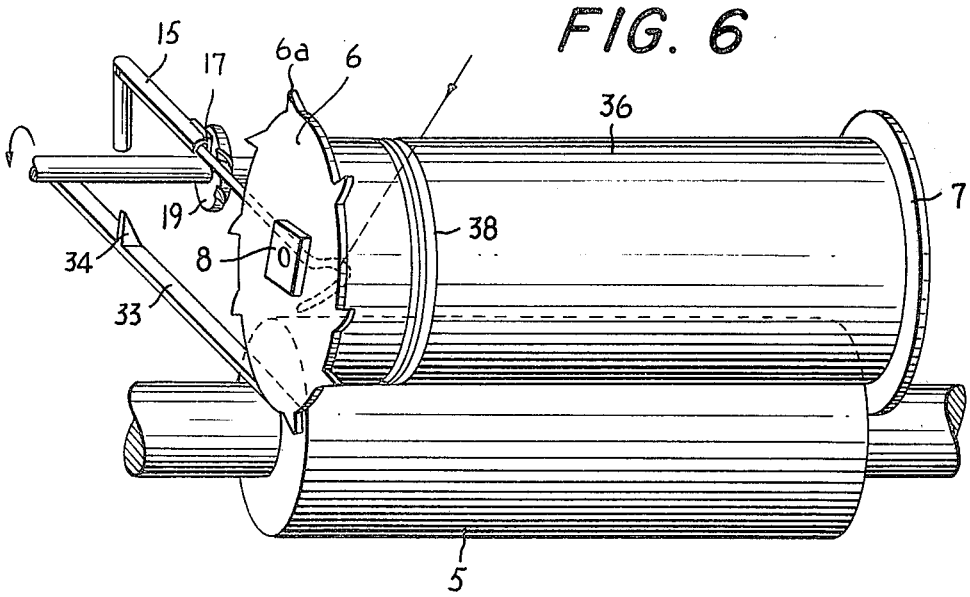

When a full bobbin is received by the cradle, as shown in FIG. 4, the bobbin tube supporting means, including the arms 8 and the side plates 6 and 7 carried thereby, are returned by the operator to a substantially vertical position, as shown in FIG. 4, and while it is in this position, a new cardboard tube 36 is inserted manually between the two side plates 6 and 7 which may include very short projections adapted to enter the open ends of the tube to centralize the latter on the side plates. After a new tube has thus been inserted between the side plates 6 and 7, the operator moves this tube to the position as shown in FIG. 5 into engagement with the drive cylinder 5. During this movement, the side plate 6 will engage the front end of the arm 33 to tilt this arm about the pivot axis 33*a* in downward direction, releasing thereby the reserve arm 15 from the projection 34 so that the reserve arm 15 will move from the position as shown in FIG. 4 back to its rest position shown in FIG. 1. It should be noted that during pivoting of the arms 8 from the position as shown in FIG. 3 to the position as shown in FIGS. 1 and 5, the cam 31 will be returned to the position as shown in FIG. 2. During this movement of the reserve arm 15 from the position shown in FIG. 3 to its rest position as shown in FIG.1, the teeth 6*a* on the side plate 6, rotating with the bobbin tube 36, by the friction between the side plate 6 and the end of the bobbin tube, will catch the yarn 1 while at the same time the catch 17 on the reserve arm 15 will engage in one of the slanted grooves 19*a* of the wheel 19 on the rotating shaft 18 so that the reserve arm 15 is temporarily maintained in the position as shown in FIG. 6 so that the yarn 14 will form a reserve tail in form of a plurality of windings 38 at the end of the tube 36.

Figure 7:
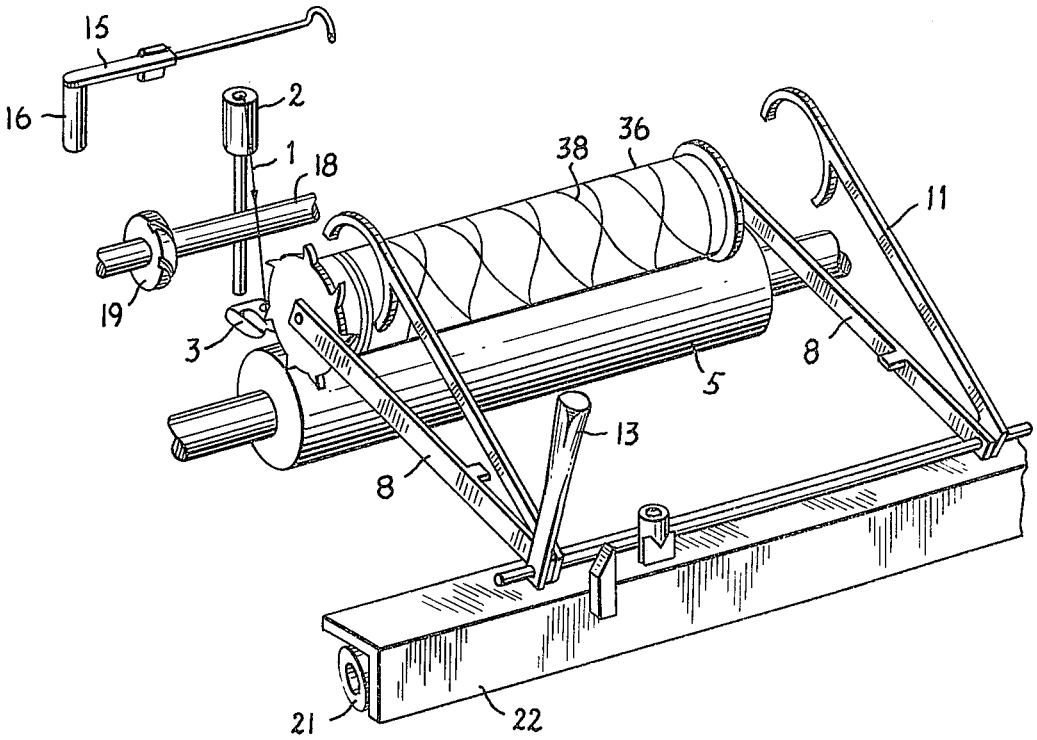
FIG. 7 shows the various elements of the device in the same position as showin in FIG. 1 during winding of the yarn on an empty bobbin tube to form a yarn package thereon.

Since the wheel 19 is continuously rotated, the catch 17 on the reserve arm 15 will be shortly released from the groove 19*a* of the wheel and the reserve arm 15 will then return to the rest position as shown in FIG. 1. The yarn 1 becomes then engaged by the yarn guide 3 so that during further operation the first turns 38 are wound on the new bobbin 36, as shown in FIG. 7, without covering the reserve tail 38.

A yarn package 14 is thus formed on the new bobbin tube, and if the yarn package is formed to its desired diameter, the doffing operation above-described is again carried out.

The device according to the invention permits to carry out the doffing operation at high speed in that it permits an operator to change the bobbins and to load new tubes in several units within a short period of time, while leaving the full bobbins on the cradle to await unloading. As compared with fully automatic devices, the device according to the present invention can be produced at very reasonable cost while still permitting a fast and expedient doffing operation.

Although the invention has been described particularly with regard to application to false twist texturizing machines, it will be understood that each of the elements described above, or two or more together may also find a useful application in other types of machines, such as twisters or the like, where the yarn is received on horizontal units lined up in the lengthwise direction of the machine.

While the invention has been illustrated and described as embodied in a device on a textile machine for changing bobbins and loading empty bobbin tubes for winding yarns thereon, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended:

1. In an device on a textile machine for changing bobbins and loading empty bobbin tubes for winding yarn thereon, a combination comprising means for releasably supporting an empty bobbin tube on opposite ends turnable about its axis, said means comprising a pair of spaced substantially parallel arms having each at one end tube engaging means adapted to engage a tube at a respective one of opposite ends, said arms being in the region of the other ends thereof connected to each other for simultaneous pivoting movement about a pivot axis substantially parallel to the axis of a tube so mounted, between a first yarn winding position and a second releasing position; means connected to said bobbin tube supporting means for pivoting the same between said positions thereof; means for moving at least said one end of at least one of said arms away from the other arm as the bobbin tube supporting means approaches said releasing position to release the bobbin tube from said engaging means; a cradle pivotable about said pivot axis; and means on said arms of said bobbin tube supporting means for engaging said cradle during pivoting of said bobbin tube supporting means from said first to said second position for moving said cradle to a corresponding second position for receiving a full bobbin upon release of the bobbin tube from said bobbin tube engaging means, said cradle engaging means being arranged so that the cradle may stay in said corresponding second position when said bobbin supporting means is returned to said first position.

2. A combination as defined in claim 1, and including means for forming an attachment tail on an empty bobbin tube supported by said bobbin tube supporting means in the first position of the latter.

3. A combination as defined in claim 1, wherein said pivoting means comprises a lever operatively connected to said arms.

4. A combination as defined in claim 1, wherein said cradle comprises two cradle arms substantially parallel to said arms of said bobbin tube supporting means, said cradle arms having at the ends thereof distant from said first pivot axis arcuate end portions for receiving opposite ends of a bobbin tube after release of the latter.

5. A combination as defined in claim 1, wherein said means for moving at least said one end of at least one of said arms of said bobbin tube supporting means away from said other arm comprises a cam.

6. In a device on a textile machine for changing bobbins and loading empty bobbin tubes for winding yarns thereon, a combination comprising yarn supply means; means for releasably supporting an empty bobbin tube turnable about its axis and for pivoting movement about a first pivot axis substantially parallel to the axis of a tube mounted on said tube supporting means between a first position in which a yarn emanating from said yarn supply means is wound on the tube, and a second tube releasing position; means connected to said bobbin tube supporting means for pivoting the same between said positions thereof; cutting means for cutting a yarn between said yarn supply means and the bobbin tube when the latter is in said releasing position; temporary yarn recovering means cooperating with the end of the cut yarn for holding it in a predetermined position; and means for forming an attachment tail on an empty bobbin tube supported by said supporting means in said first position of the latter, said means for forming an attachment tail comprising a reserve arm having a hook end and being pivotable about a second pivot axis, in a plane intersecting the yarn extending from said yarn supply means to said temporary yarn recovery means, between a rest position disengaged from said yarn and an engaging position engaging and deflecting the yarn.

7. A combination as defined in claim 6, wherein said temporary yarn recovery means comprise a receptacle adapted to be connected to a source of vacuum, and a suction tube communicating with said receptacle and having an open suction orifice adjacent the yarn extending from said yarn supply means to the bobbin received in said cradle so as to suck the cut end of the yarn into said receptacle.

8. A combination as defined in claim 6, wherein said bobbin tube supporting means comprise a pair of spaced substantially parallel arms having each at one end tube engaging means adapted to engage a respective one of opposite ends of a tube and being in the region of the other ends thereof connected to each other for pivoting movement about said first pivot axis, and including means for moving at least said one end of at least one of said arms away from the other arm as the bobbin tube supporting means approaches said second position to release the bobbin tube from said engaging means.

9. A combination as defined in claim 8, wherein each of said arms of said bobbin supporting means carries at said one end thereof circular side plates, one of said side plates being provided with a toothed periphery cooperating with said reserve arm in forming the attachment tail.

10. A combination as defined in claim 6, and including transmission means between said bobbin tube supporting means and said reserve arm for moving said reserve arm between said rest and said engaging position during movement of said bobbin tube supporting means between said positions thereof.

* * * * *